United States Patent [19]

Pender

[11] Patent Number: 4,739,894

[45] Date of Patent: Apr. 26, 1988

[54] CONTAINER ASSEMBLY FOR GARBAGE

[76] Inventor: Richard A. Pender, 897 Westfield Ave., Rahway, N.J. 07065

[21] Appl. No.: 106,155

[22] Filed: Oct. 8, 1987

[51] Int. Cl.[4] ..... B65D 91/00

[52] U.S. Cl. ..... 220/1 T; 220/23.4; 220/20.5

[58] Field of Search ..... 220/1 T, 1 H, 4 C, 4 D, 220/23.2, 23.4, 23.6, 23.83, 23.86, 20.5, 83, 85 F

[56] References Cited

U.S. PATENT DOCUMENTS

| | | | |
|---|---|---|---|
| 193,479 | 7/1877 | Burgin | 220/23.4 X |
| 909,715 | 1/1909 | Troegeler | 220/23.4 X |
| 3,082,901 | 3/1963 | Nakagawa | 220/1 T X |
| 3,166,212 | 1/1965 | Resos | 220/23.4 |
| 3,720,346 | 3/1973 | Cypher | 220/1 T X |
| 3,893,615 | 7/1975 | Johnson | 220/1 T X |

*Primary Examiner*—Steven M. Pollard
*Attorney, Agent, or Firm*—Kenyon & Kenyon

[57] ABSTRACT

The container assembly is formed of four semi-cylindrical with an upper pair of containers stacked on a lower pair of containers. The upper containers have recessed walls which mate to provide chutes to the lower containers for the segregation of different types of garbage. The container assembly can be readily separated into the individual components for recycling of aluminum cans, bottles and the like.

17 Claims, 2 Drawing Sheets

CONTAINER ASSEMBLY FOR GARBAGE

This invention relates to a container assembly for garbage. More particularly, this invention relates to a container assembly for receiving different types of garbage for recycling purposes.

Heretofore, containers for garbage have generally been of a single chamber type so that different types of garbage can be deposited therein for subsequent removal. However, garbage collection and removal has become a significant problem in many communities so that various solutions have been sought to reducing the amount of garbage that requires removal, for example, to a garbage dump, land fill cite and/or incineration plant. In some cases, municipal regulations require a home owner or business establishment to separate garbage into different types, for example to separate bottles, aluminum cans, plastic containers, newspapers and the like from each other not only for recycling purposes but also to reduce the amount of residual garbage which requires removal to a garbage dump, land fill or incineration plant.

Because of the requirement to separate garbage into different types, home owners and business establishments have usually resorted to setting aside separate containers for each type of garbage. For example, one container may be set aside for aluminum cans, a second container for plastic materials, a third container for newspapers and paper and a fourth container for any remaining garbage. However, this requires a rather large space and is not generally convenient to home owners and businesses.

In other cases, compartmented trash receptacles for example as described in U.S. Pat. Nos. 3,648,875; 3,720,346 and 3,904,218. Generally, these receptacles have a plurality of containers which are disposed in side-by-side relation within a common housing or which are held together by a common cover. However, such receptacles provide garbage-receiving compartments which are relatively narrow and relatively deep. Because of this, the compartments are relatively difficult to clean. Further, if the compartments are too narrow, some garbage such as large plastic bottles may become wedged in place so that a compartment cannot be totally filled. Still further, in some cases as described in U.S. Pat. Nos. 3,648,875 and 3,904,218, rather cumbersome support structures are required to hold the inidividual compartments together.

Accordingly, it is an object of the invention to provide a container assembly of simple and compact construction for receiving different types of garbage in segregated manner.

It is another object of the invention to be able to segregate garbage in a rapid manner for removal purposes.

It is another object of the invention to provide a relatively simple container assembly which takes up a minimum of space and which can be readily used by a home owner.

It is another object of the invention to provide a container assembly for multiple types of garbage which can be readily assembled and easily cleaned.

Briefly, the invention provides a container assembly for garbage which includes a plurality of containers which are stacked in vertical relation with each defining a compartment for receiving a different type of garbage from the other chambers. In addition, the containers are stacked relative to each other so as to provide vertical chutes between adjacent containers by means of which one or more types of garbage can be directed into a container aligned below the chute or chutes.

The stacked containers are also provided with suitable means for nesting the vertically disposed containers with each other. In this way, the container assembly can be moved about as a single unit.

The container assembly is also provided with a lid which is disposed about the uppermost containers. This lid also serves to hold the uppermost containers together as a unit.

The individual containers may be constructed in any suitable geometric shape so that when the containers are assembled a compact unit is provided for the collection of different types of garbage.

The container assembly is particularly suitable for the recycling of materials. For example from time-to-time, the container assembly can be dis-assembled so that the individual containers having, for example aluminum cans therein, can be separately brought to a recycling station, or otherwise collected by a garbage collection agency. In similar manner, the remaining containers can be individually handled.

Further, because the individual containers can be readily handled, cleaning of any one container can be readily accomplished.

These and other objects and advantages of the invention will become more apparent from the following detailed description taken in conjunction with the accompanying drawings wherein.

Figure 1A:
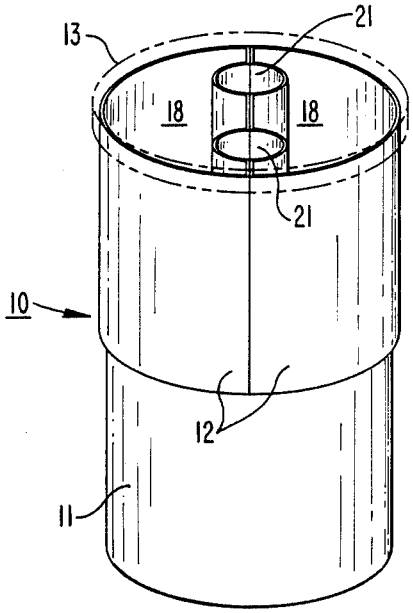
FIG. 1A illustrates a perspective view of a container assembly constructed in accordance with the invention.
Figure 1B:
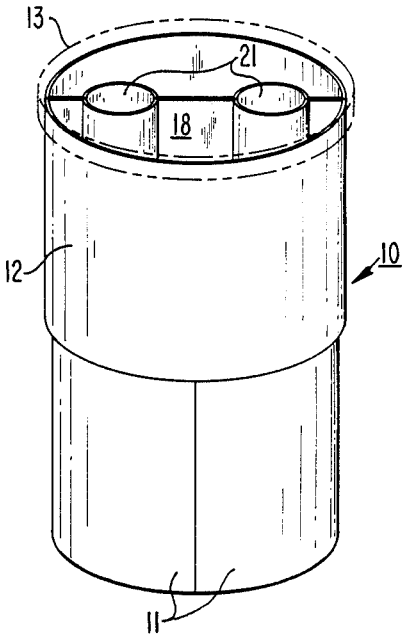
FIG. 1B illustrates a perspective view of the container assembly of FIG. 1A turned 90°.

Referring to FIGS. 1A and 1B, the container assembly 10 is constructed for the receiving of different types of garbage, for example for removal and recycling purposes. The container assembly 10 is comprised of a lower pair of shell-like containers 11 disposed in adjacent relation and an upper pair of shell-like containers 12 disposed in adjacent relation above the lower pair of containers 11. In addition, a lid 13, shown in phantom lines, is disposed about the upper pair of containers 12.

Figure 2:
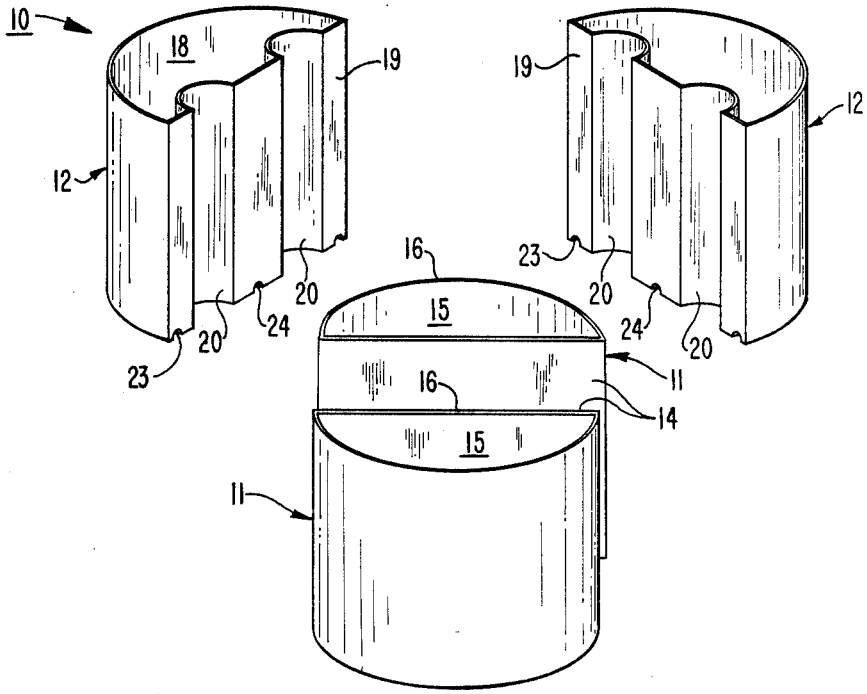
FIG. 2 illustrates an exploded view of the container assembly of FIG. 1A.

Referring to FIG. 2, each of the lower containers 11 has an opened upper end for receiving garbage. As indicated in FIGS. 4A to 4E each container 11 is of semi-cylindrical shape to define a flat inside face 14 to mate in flat face-to-face contact with an adjacent container 11 and to define a compartment 15 for receiving garbage. Also, each container 11 has an upstanding peripheral edge 16 about the garbage-receiving compartment 15 and a bottom 17 for closing off the garbage-receiving compartment 15.

Each container 11 is molded in one-piece manner of self-supporting plastic or may be formed in other suitable manner.

Referring to FIG. 2, each of the upper containers 12 has an open upper end and defines a garbage-receiving compartment 18. In addition, each upper container 12 is of semi-cylindrical shape with a recessed wall 19 facing the other upper container 12. As shown, each wall 19 defines a pair of semi-circular recesses 20 so as to define a vertical chute 21 (see FIG. 1A) when the containers 12 are brought together in mating relation.

As indicated in FIGS. 3A–3D, each upper container 12 is of one-piece plastic construction and has an integral bottom 22 closing off the garbage-receiving compartment 18.

Referring to FIGS. 1A and 1B, the containers 11, 12 are stacked in vertical relation so that the upper containers 12 each provide a compartment 18 for receiving a different type of trash from the other. In addition, the chutes 21 provided between these upper containers 12 provide for access to the lower containers 11. In this respect, each chute 21 is aligned with only one of the lower containers 11 so that different types of garbage may be deposited in each of the lower containers 11.

Figure 3D:
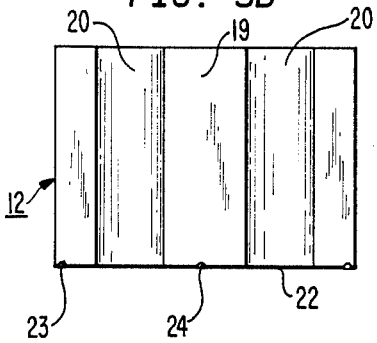
FIG. 3D illustrates a side view of a recessed wall of the container of FIG. 3A.
Figure 3A:
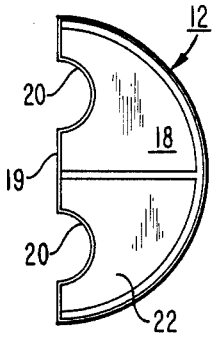
FIG. 3A illustrates a top view of an uppermost container of FIG. 1A.
Figure 3C:
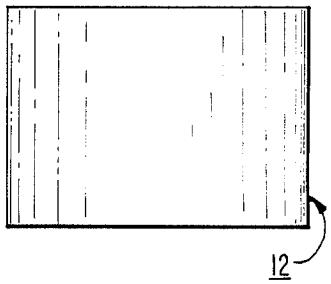
FIG. 3C illustrates a side view of the container of FIG. 3A.
Figure 3B:
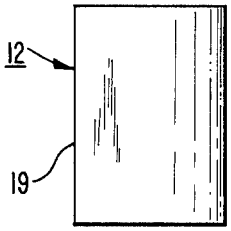
FIG. 3B illustrates a front view of the container of FIG. 3A.
Figure 3E:
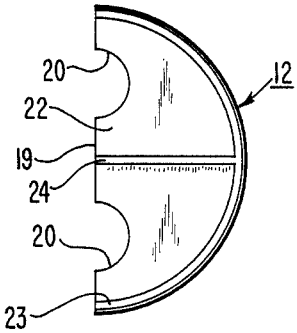
FIG. 3E illustrates a bottom view of the container of FIG. 3A.
Figure 4A:
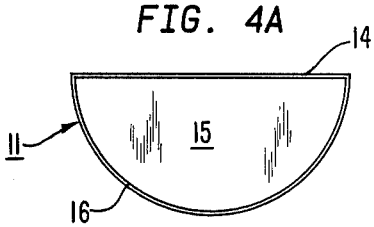
FIG. 4A illustrates a top view of a lowermost container of the assembly of FIG. 1A.
Figure 4E:
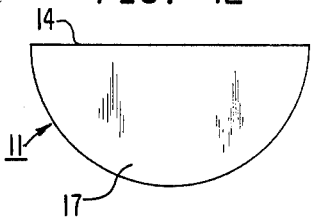
FIG. 4E illustrates a bottom view of the container of FIG. 4A.
Figure 4C:
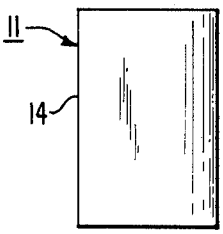
FIG. 4C illustrates a left side view of the container of FIG. 4A.
Figure 4B:
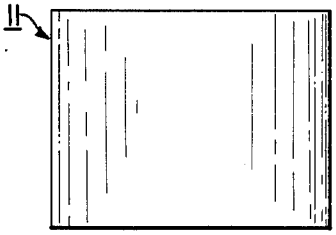
FIG. 4B illustrates a front view of the container of FIG. 4A.
Figure 4D:
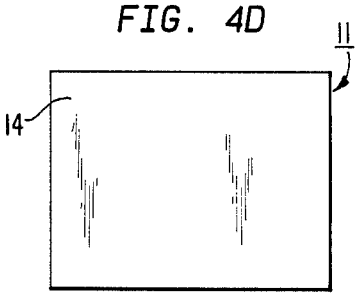
FIG. 4D illustrates an inside face of the container of FIG. 4A.

In order to enhance the assembled condition of the containers 11,12, means are provided for nesting of the upper containers 12 on the lower containers 11. For example, as indicated in FIGS. 2, 3D and 3E, the bottom 22 of each upper container 12 has a peripheral groove 23 formed in the bottom surface thereof as well as a centrally extending groove 24. As indicated in FIG. 3A, the bottom 22 of each container 12 has a raised portion inside the compartment 18 corresponding to the grooves 23, 24. These grooves 23, 24 are sized so to receive the upstanding peripheral edge 16 (see FIG. 2) of each lower container 11 in mating relation, for example, in a snap-fit manner. Thus, the centrally extending groove 24 of one upper container 12 receives the upstanding edges 16 of the two containers 11. Likewise, a peripheral groove 23 of an upper container 12 receives one-half of the curved peripheral edge of each container 11.

Referring to FIG. 1A, the lid 13 may provide a space above the upper containers 12 for receiving newspapers and the like.

Each individual container 11, 12 is made of suitable capacity, for example of twelve gallon capacity. However, any other suitable capacity may be provided. In particular, the individual containers can be sized so as to readily handle large items, such as plastic bottles, without jamming occurring within the compartments. Further, the containers 11, 12 may be of different heights so as to provide different capacities from each other.

In use, an individual wishing to separate garbage would dedicate any of the four chambers of the container assembly to a specific type of garbage, for example, glass, aluminum cans, steel cans, plastics, and the like, depending upon the recycling program established in the particular community involved. Removing the lid 13 will expose the open portions of the two upper containers 12 and the chutes 21 communicating to the lower containers 11. The individual would then place the garbage to be discarded into the appropriate container 11, 12.

Depending upon the collection procedures established in any particular community, the individual could place the entire assembly for curb side pick-up or the individual containers 11, 12 could be segregated for individual pick-up.

The invention thus provides a container assembly for segregating garbage which is of relatively compact construction. Further, the assembly may be used as a single unit instead of having to use four or five trash cans per dwelling.

The container assembly, when assembled, is waterproof when the lid is in place and may be stored in an outdoor environment.

Further, the container asesmbly can be readily disassembled when desired and the individual containers can be easily handled and cleaned as compared with conventional large trash cans.

Still further, in the event of damage to any of the containers, only the damaged container need be replaced rather than having to replace a complete assembly.

What is claimed is:

1. A container assembly for receiving different types of garbage comprising a first pair of containers disposed in adjacent relation, each container having an open upper end for receiving a different type of garbage from the other container; and a second pair of containers disposed in adjacent relation to each other and above said first pair of containers, each of said second pair of containers having an open upper end for receiving a different type of garbage from the other containers, each of said second pair of containers having a recessed wall facing the other of said second pair of containers to define a pair of vertical chutes therebetween, each said chute communicating with a respective one of said first pair of containers.

2. A container assembly as set forth in claim 1 wherein each container is of semi-cylindrical shape.

3. A container assembly as set forth in claim 1 wherein each said first pair of containers has an upstanding peripheral edge and each said second pair of containers has a peripheral groove in a bottom surface thereof receiving a portion of an upstanding edge of each one of said first pair of containers in nesting relation.

4. A container assembly as set forth in claim 3 wherein each of said second pair of containers has a centrally extending groove in a bottom surface receiving a second portion of an upstanding edge of each one of said first pair of containers in nesting relation.

5. A container assembly as set forth in claim 4 wherein each container is made of self-supporting plastic.

6. A container assembly as set forth in claim 4 wherein each container is of semi-cylindrical shape.

7. A container assembly as set forth in claim 6 wherein each container is made of self-supporting plastic.

8. A container assembly as set forth in claim 1 which further comprises a lid disposed about and over said second pair of containers.

9. A container assembly for recycling garbage comprising a pair of containers disposed in adjacent relation, each said container having an open end for receiving a different type of garbage from the other container, each of said containers having a recessed wall facing the other of said containers to define at least one vertical chute therebetween for passage of a third type of garbage therethrough;

at least a third container below said pair of containers and aligned with said chute to receive the third type of garbage; and means for nesting said pair of containers with said third container in vertical relation.

10. A container assembly as set forth in claim 9 wherein said means includes an upstanding peripheral edge on said third container and a groove in a bottom of each of said pair of containers receiving said edge in mating relation.

11. A container as set forth in claim 9 wherein each container is made of self-supporting plastic.

12. A container as set forth in claim 9 wherein said facing recessed walls define a pair of said vertical chutes.

13. A container assembly for garbage comprising a first pair of containers disposed in adjacent relation, each said container having an open end for receiving a different type of garbage from the other container, each of said containers having a recessed wall facing the other of said containers to define a pair of vertical chutes therebetween for passage of different types of garbage therethrough; and a second pair of containers below said first pair of containers, each container of said second pair of containers being aligned with a respective one of said chutes to receive one type of garbage therefrom.

14. A container assembly as set for in claim 13 which further comprises means for nesting said first pair of containers on said second pair of containers.

15. A container assembly as set forth in claim 14 wherein said means includes an upstanding edge on each of said second pair of containers and a groove in each of said first pair of containers receiving a respective edge in mating relation.

16. A container assembly as set forth in claim 15 wherein each container is of semi-cylindrical shape.

17. A container assembly as set forth in claim 15 wherein each container is made of self-supporting plastic.

* * * * *

UNITED STATES PATENT AND TRADEMARK OFFICE

CERTIFICATE OF CORRECTION

PATENT NO. : 4,739,894

DATED : April 26, 1988

INVENTOR(S) : Richard A. Pender

It is certified that error appears in the above-identified patent and that said Letters Patent is hereby corrected as shown below:

In the Abstract, line 2 "cal with" should be -cal containers with-
Column 1, line 13 "to" should be -for-
Column 3, line 42 "so to" should be -so as to-
Column 4, line 18 "asesmbly" should be -assembly-

Signed and Sealed this

Twenty-seventh Day of September, 1988

*Attest:*

DONALD J. QUIGG

*Attesting Officer*

*Commissioner of Patents and Trademarks*